US010643587B1

(12) United States Patent
McCormick

(10) Patent No.: US 10,643,587 B1
(45) Date of Patent: May 5, 2020

(54) FULCRUM TREMOLO CLAW LOCK RESONATOR

(71) Applicant: Lance McCormick, Chatsworth, CA (US)

(72) Inventor: Lance McCormick, Chatsworth, CA (US)

( * ) Notice: Subject to any disclaimer, the term of this patent is extended or adjusted under 35 U.S.C. 154(b) by 0 days.

(21) Appl. No.: 16/450,750

(22) Filed: Jun. 24, 2019

(51) Int. Cl.

| | |
|---|---|
| ***G10D 3/14*** | (2020.01) |
| ***G10D 3/153*** | (2020.01) |
| ***G10D 3/06*** | (2020.01) |
| ***G10D 3/04*** | (2020.01) |
| ***G10D 1/08*** | (2006.01) |
| ***G10D 3/10*** | (2006.01) |

(52) U.S. Cl.
CPC ..... *G10D 3/153* (2020.02); *G10D 1/085* (2013.01); *G10D 3/04* (2013.01); *G10D 3/06* (2013.01); *G10D 3/10* (2013.01)

(58) Field of Classification Search
CPC ..... G10D 3/153; G10D 3/146
See application file for complete search history.

(56) References Cited

U.S. PATENT DOCUMENTS

| | | | | |
|---|---|---|---|---|
| 3,599,524 A | | 8/1971 | Jones | |
| 4,135,426 A | | 1/1979 | Richard | |
| 4,171,661 A | | 10/1979 | Rose | |
| 4,201,108 A | | 5/1980 | Bunker | |
| 4,206,679 A | | 6/1980 | Wilson | |
| 5,196,641 A | * | 3/1993 | Schaller | G10D 3/153 84/740 |
| 5,419,227 A | * | 5/1995 | Lavineway | G10D 3/153 84/313 |
| 5,986,192 A | * | 11/1999 | Wingfield | G10D 3/153 84/313 |
| 6,015,945 A | * | 1/2000 | Borisoff | G10D 3/153 84/313 |
| 6,198,036 B1 | * | 3/2001 | Hoshino | G10H 3/185 84/313 |
| 6,812,389 B2 | * | 11/2004 | Trooien | G10D 3/153 84/313 |
| 6,943,284 B2 | * | 9/2005 | Didan | G10D 3/153 84/313 |
| 7,145,065 B2 | * | 12/2006 | Geier | G10D 3/153 84/313 |
| 8,536,430 B2 | | 9/2013 | McCabe | |
| 9,502,010 B1 | * | 11/2016 | Cardozo | G10D 1/085 |
| 9,697,809 B2 | * | 7/2017 | Cardozo | G10D 1/085 |
| 10,157,597 B1 | * | 12/2018 | Green | G10D 1/085 |
| 2013/0047816 A1 | * | 2/2013 | Rukavina | G10D 3/153 84/313 |

* cited by examiner

*Primary Examiner* — Robert W Horn

(57) ABSTRACT

Sonic improvement for all stringed instruments that employ a fulcrum tremolo bridge system with back of instrument counter tensioning springs. The improvement is provided by securing the spring retaining claw assembly of said system to a flat plate of material which in turn is secured to the instrument body. The presence of the plate will enhance the sound quality of said instrument in a perceivable way to the human ear.

12 Claims, 2 Drawing Sheets

FULCRUM TREMOLO CLAW LOCK RESONATOR

FEDERALLY SPONSORED RESEARCH

Not Applicable

SEQUENCE LISTING OF PROGRAM

Not Applicable

FIELD OF INVENTION

This invention relates to a volume, sustain, and frequency response improvement for guitars and stringed musical instruments consisting of a body, neck, and plurality of strings under tension employing a fulcrum tremolo string bridge system.

BACKGROUND OF INVENTION

Stringed musical instruments, such as the electric guitar, have featured an option since the 1950's called a tremolo. It is a fulcrum point string bridge located on the instrument body face that allows the performer to lower or raise the pitch of all strings simultaneously. The most widely employed type of fulcrum tremolo system generates the needed string counter tension via a plurality of springs located in a cavity on back of instrument body. One end of the plurality of springs is attached to the bottom portion of the bridge called the "block" and the other to a piece of flanged steel called the "claw". The claw is secured to the guitar body via two wood screws to the spring cavity wall opposite that of the bridge block. The two screws allow for tension adjustment of the tremolo system. The drawback to the current tremolo system is the lack of mechanical coupling strings have with the instrument body. The screw heads and bridge fulcrum points alone fail to realize the vibrating strings full potential for sound wave transfer, thereby attenuating the frequency response, amplitude, and sustain of sound waves resonating into the instrument body and neck.

SUMMARY OF INVENTION

It is thereby the intention of this invention to capture a greater portion of the vibrating string's sound wave energy via improved mechanical coupling to instrument body and neck increasing amplitude, sustain, and frequency response thereby improving overall performance of instrument.

This invention resulted from the realization that employing a secondary connection point between the spring retaining "claw" and instrument body audibly enhanced the sound of an electric guitar using a Fulcrum Tremolo Bridge System.

The Fulcrum Tremolo Claw Lock Resonator is a "resonator plate" that consists of a flat piece of material capable of being drilled and tapped for machine screw thread(s) and or slotted for tee nut(s). The "resonator plate" is anchored to instrument body back, located on the inside of counter tensioning spring cavity under the plurality of counter tensioning springs and flanged metal claw of fulcrum tremolo system. The "resonator plate" anchoring is achieved via screws or adhesive agent to the innermost surface of spring counter tension cavity, the surface that is parallel to instrument face. The "claw" is then compression coupled to "resonator plate" via machine screw(s) or other multi use fastener method. The claw assembly facilitates the need of "claw" position adjustment, forward or backward. Due to changes of instrument string tension via the alteration of string gauge size or alternate tuning preference(s) of musician. the "resonation plate" must facilitate that the "claw" be repositionable. This is achieved with multiple machine screw positions, elongated screw slot(s) in claw, and/or a sliding tee nut channel. Once the tension, counter tension relationship between instrument strings and counter tensioning springs is arrived at for desired fulcrum tremolo string bridge position the "claw" can then be firmly secured to the "resonator plate" maximizing mechanical coupling of strings and their generated sound waves into instrument body.

DISCLOSURE OF DETAILED DESCRIPTION OF THE PREFERRED EMBODIMENT

Figure 1:
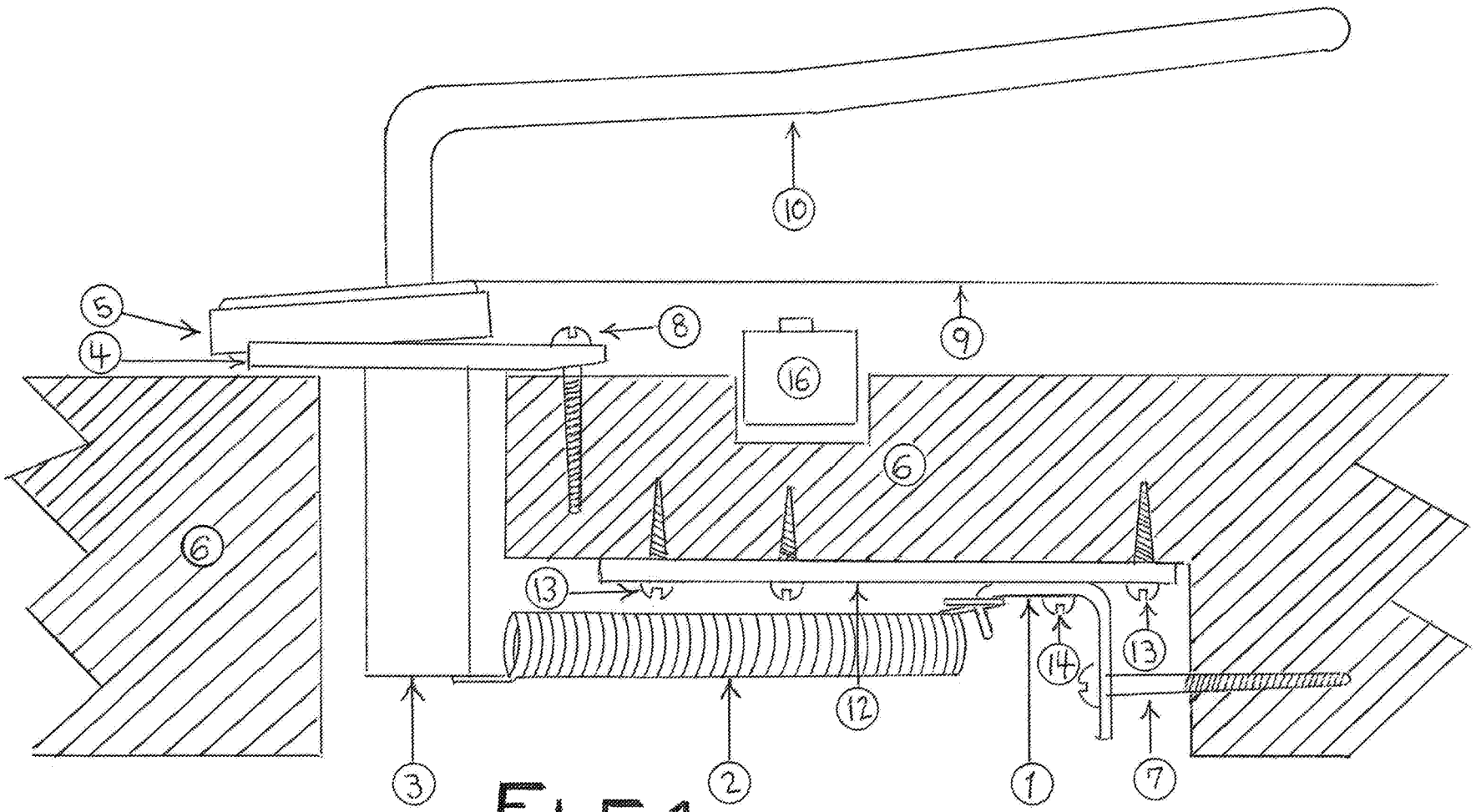
FIG. 1 is a side cut away view of an electric guitar employing a fulcrum tremolo spring bridge.

Other objects, features, and advantages will occur from the following description of a preferred embodiment and the accompanying drawings:

FIG. 1 demonstrates the wooden guitar body 6, the strings 9, the electromagnetic pickups 16, the arm to activate tremolo 10, the bridge mounting screws and fulcrum point 8, the bridge platter 4, the bridge string saddles 5, the bridge block 3, tensioning springs 2, Fulcrum Tremolo Claw Lock Resonator 12, Resonator mounting to body screws 13, the claw 1, the claw locking to resonator plate screw(s) 14, the tremolo system tension adjustment screws 7

Figure 2:
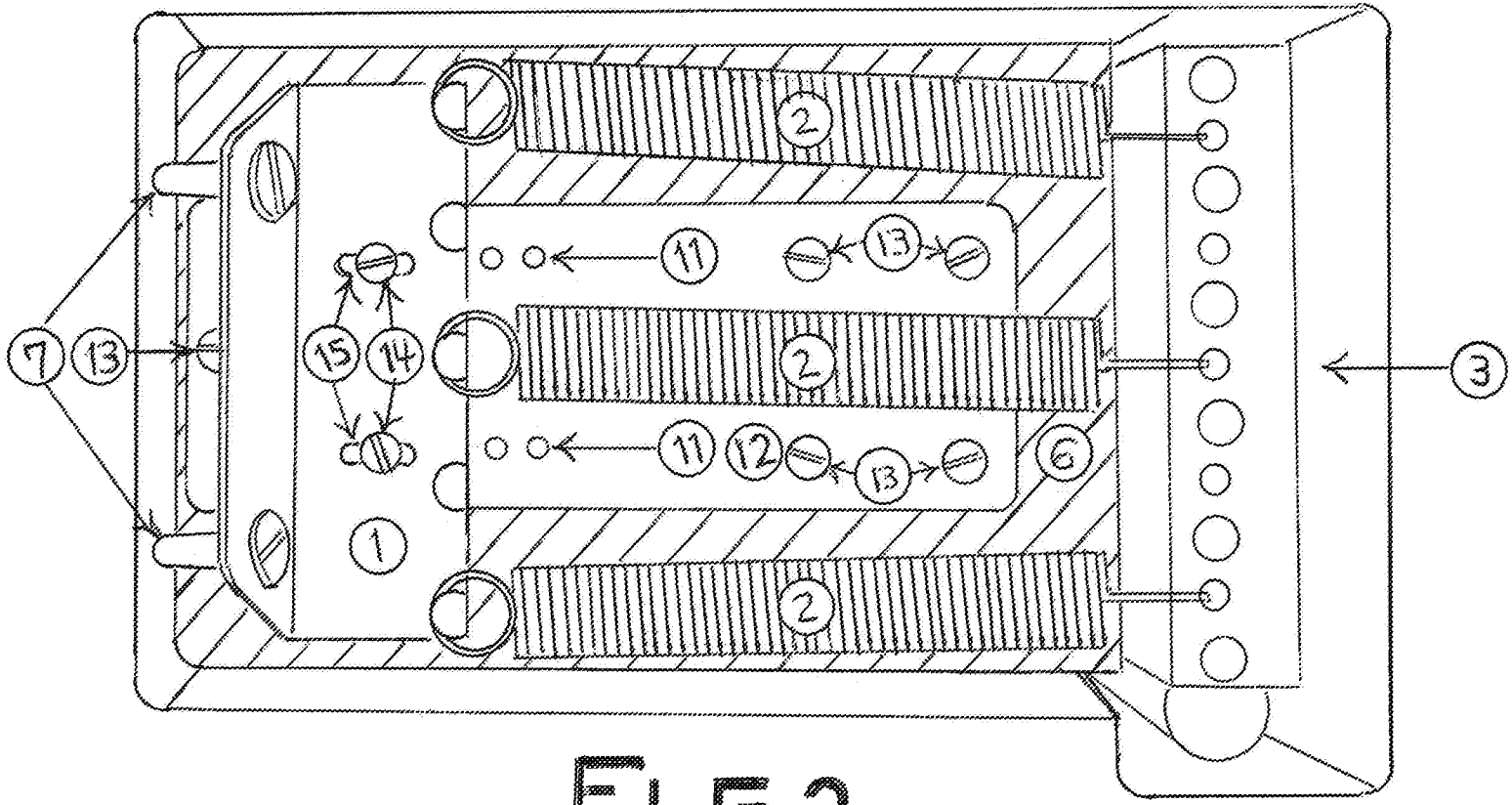
FIG. 2 is a top view of spring counter tensioning cavity on back of guitar that employs a fulcrum tremolo system.

FIG. 2 demonstrates the Fulcrum Tremolo Claw Lock Resonator plate 12, the mounting to body screws 13, the spring retaining claw 1, the claw locking to resonator plate screw(s) 14, the elongated claw mounting to resonator plate screw holes 15, the claw spring tension adjustment screws 7, the springs 2, and the bridge block 3.

Screws 7 provide the normal manner that the spring retaining claw assembly is mounted. The modified form of spring retaining claw assembly provides slots 15 for receiving screws 14. The resonator plate in the illustrated variant comprises a series of screw holes around its perimeter where screws 13 attach to the rear of the spring cavity to the body 6. According to the adjustment position of the screws 7, screws 14 into an alternate set of threaded screw holes 11. Two parallel rows of holes 11 are provided is a position accessible between adjacent springs 2.

The Fulcrum Tremolo Claw Lock Resonator can be retrofitted or original equipment on any stringed musical instrument with fulcrum tremolo system that employs back of instrument body spring counter tension method most commonly used in electric guitar manufacturing. With the addition of two holes in flanged (L-shaped) spring retaining claw, and providing resonator plate and connecting fasteners, the kit provides an increase in amplitude, frequency response, and sustain of vibrating strings of instrument. A retrofit kit includes the resonator plate, the assembly screws 13, 14 and a spring claw assembly 1. Assembly involves replacing spring claw assembly 1 with a slotted variant, attaching the springs 2 to the spring claws, assembling spring claw assembly together with the resonator plate, and attaching the resonator plate 12 to the body of the instrument.

Adjustment involves setting the tension on the springs 2 by adjusting screws 7. If a large adjustment is necessary remove the screws 14. After adjusting the spring tension, re-attach and tighten the machine screws 14 through slots 15 in an adjacent set of the mounting holes 11.

Making the claw lock resonator plate out of a material that has magnetic properties can affect the output signal of an electromagnetic pickup in stringed instrument in a musically pleasing and beneficial way as perceived by human ear.

The instrument with the fulcrum tremolo string bridge system will be sonically improved by the addition of a Fulcrum Tremolo Claw Lock Resonator plate. The resonator provides an expanded surface area capable of transferring sound wave energy in the core of wooden string instrument. So amplitude, sustain, and frequency response are all improved. With enhanced low frequency coupling of fulcrum tremolo system to the instrument core, the entire range of pitches the instrument can produce are audibly improved. The presence of the invention enhances low frequency response to the human ear, interpreted as a warmer sound, a richer sound, and a sound that needs less electronic processing to convey musical pleasure as perceived by our ears.

The securing of the spring claw to the Fulcrum Tremolo Claw Lock Resonator reduces the potential movement of claw when tremolo is activated by player compared to the prior spring claw assembly retained only by two wood screws, thereby improving instrument tremolo systems tuning accuracy in returning to the non-pitch varied position of the tremolo bridge. Increasing the mass of the instrument body with the addition of Fulcrum Tremolo Claw Lock Resonator in the center or core of the instrument, instrument can allow the instrument to more efficiently resonate sound energy outward to exterior edges of guitar body.

The invention claimed is:

1. A stringed musical instrument consisting of a solid resonating body having an elongated longitudinal inset cavity within at least the upper, rear boundary of said body;

a neck; and a plurality of strings under tension that are counter tensioned by springs in a fulcrum tremolo string bridge system, the tremolo system comprising a resonator block, where the inset cavity in the body receives the resonator block in a resonator block cavity portion of the inset cavity that extends through the body of the instrument from the front and the resonator block is pivotally movable in the cavity portion;

a spring retaining claw assembly comprising claws;

tremolo tension springs mounted between the claws and the resonator block; and fasteners securing the spring retaining claw assembly of said system to a flat plate of a material which in turn is secured to instrument body.

2. The stringed musical instrumental instrument of claim 1, wherein the flat plate is a metal or a non-metal, selected according to the desired sound modification characteristic.

3. The stringed musical instrument of claim 1, wherein the spring retaining claw assembly has an L-shape and the upright of the L-shape has screw holes and the horizontal part has slotted screw holes, where a screw through the upright of the L-shape mounts the spring retaining claw assembly to the solid body of the instrument and the horizontal part of the L-shape has screws through the slots into the flat plate of metal.

4. The stringed musical instrument of claim 2, wherein the springs, spring claw assembly and the flat plate are placed in the spring portion of the inset cavity, where the depth of the inset cavity is oriented into the solid body of the instrument from the rear of the body, and there is a reduced thickness part of the body bounding the cavity which houses the instrument pick-ups on the front side and the elongated direction of the spring portion of the inset cavity is in the direction which the musical strings extend from fulcrum tremolo bridge.

5. The stringed musical instrument of claim 3, wherein the spring mount cavity portion of the inset cavity is bounded by inset walls on the sides and at the spring claw assembly mount wall which is opposite to the resonator block cavity portion, wherein screws extend from the upright of the L-shape of the spring mount claw assembly into the spring claw assembly mount wall.

6. The stringed musical instrument of claim 4, wherein the flat sheet of metal is elongate in the spring length direction of the spring mount cavity portion of the inset cavity and extends to a position near the resonator block portion of the inset cavity, and the width of the flat sheet of metal is one more of the width of the resonator block cavity portion, and the thickness of the flat sheet of metal is twice or more the thickness the spring mount claw assembly and where variations in length, width, thickness and material of the plate can tailor the sound of the stringed instrument.

7. The stringed musical instrument of claim 5, where the material of the plate is a magnetic material, the instrument is electrified by magnetic pickups and the plate when mounted is on the opposite side of the body.

8. The stringed musical instrument of claim 2, wherein the plate is tapped for threads or slotted for tee nuts, where the machine screws attach alternately to the tapped threads or to tee nuts in the slots for tee nuts.

9. The stringed musical instrument of claim 5, wherein anchoring is achieved via screws or adhesive agent to the innermost surface of spring counter tension cavity, the surface that is at the back of the body in parallel to the instrument face.

10. A fulcrum tremolo claw lock resonator kit for retrofitting the fulcrum tremolo spring mount, comprising an alternate spring claw assembly having spring claws that mounts to the spring claw assembly mount wall of the spring mount cavity by the original spring claw screws, the spring claw assembly comprising pair of screw slots;

a pair of machine screws;

a plate having a length just short the length of spring cavity, a width half or more the width of the spring mount cavity, a thickness that is twice or more the thickness of the fulcrum tremolo spring mount, the plate comprising screw holes around the perimeter and two rows of threaded holes arranged for attachment by machine screw and aligned with slots of the alternate spring claw assembly;

a set of mount screws for the holes around the perimeter of the medal plate that thread into the body of musical instrument;

wherein the alternate spring claw assembly mounts by machine screw to the metal plate and the metal mounts to the body of the string instrument in the body;

where variations in length, width, thickness and material of the metal plate can tailor the sound of the stringed instrument.

11. The fulcrum tremolo claw lock resonator kit of claim 9, where the metal plate when mounted is opposite the electromagnetic pickups of the instrument and the material of the plate is magnetic metal material.

12. The stringed musical instrumental instrument of claim 9, wherein the flat plate is a metal or a non-metal, selected according to the desired sound modification characteristic.

* * * * *